US007353093B2

(12) United States Patent
Bamfield et al.

(10) Patent No.: US 7,353,093 B2
(45) Date of Patent: Apr. 1, 2008

(54) TEMPLATE CROSSING DESIGN AND PROGRAMMING FOR HIGHWAY-RAIL GRADE CROSSINGS

(75) Inventors: Richard D. Bamfield, Upland, CA (US); Richard V. Peel, Mountain Home, AR (US); Martin Paget, Anaheim Hills, CA (US)

(73) Assignee: Safetran Systems Corporation, Louisville, KY (US)

( * ) Notice: Subject to any disclaimer, the term of this patent is extended or adjusted under 35 U.S.C. 154(b) by 212 days.

(21) Appl. No.: 11/132,007

(22) Filed: May 18, 2005

(65) Prior Publication Data

US 2006/0265111 A1 Nov. 23, 2006

(51) Int. Cl.
*G05D 1/00* (2006.01)

(52) U.S. Cl. ..... 701/19; 701/20; 246/111; 246/473.1

(58) Field of Classification Search ..... 701/19, 701/20; 246/111, 473.1
See application file for complete search history.

(56) References Cited

U.S. PATENT DOCUMENTS

2007/0084974 A1* 4/2007 Sharkey et al. ..... 246/473.1

OTHER PUBLICATIONS

INVENSYS—Application Guidelines, Microprocessor Based Grade Crossing Predictor Model 3000 Family.

Safetran Systems Corporation, Instruction & Installation, Solid-State Crossing Controller III Plus (SSCC 111 PLUS) 91190, 91195, Apr. 2004, Document No. SIG-00-02-03, Version D.

Safetran Systems Corporation, Instructions & Installation, Microprocessor Based Grade Crossing Predictor Mode: 3000 Family, Apr. 2002, Document No. SIG-00-00-02, Version B.

* cited by examiner

*Primary Examiner*—Gertrude A. Jeanglaude
(74) *Attorney, Agent, or Firm*—Cook, Alex, McFarron, Manzo, Cummings & Mehler, Ltd.

(57) ABSTRACT

A method of programming or designing application logic for a highway-rail grade crossing warning system including the steps of providing a set of templates, each template of the set of templates defining a track circuit application for a grade crossing with different characteristics, selecting a template from the set that best corresponds to the track circuit application at the grade crossing, defining a set of default programming parameters for each template to program the controller, and inputting additional parameters into the controller to define other characteristics of the track circuit application. A visual representation of each template may be provided. This invention is also directed to the set of templates for programming the controller.

22 Claims, 9 Drawing Sheets

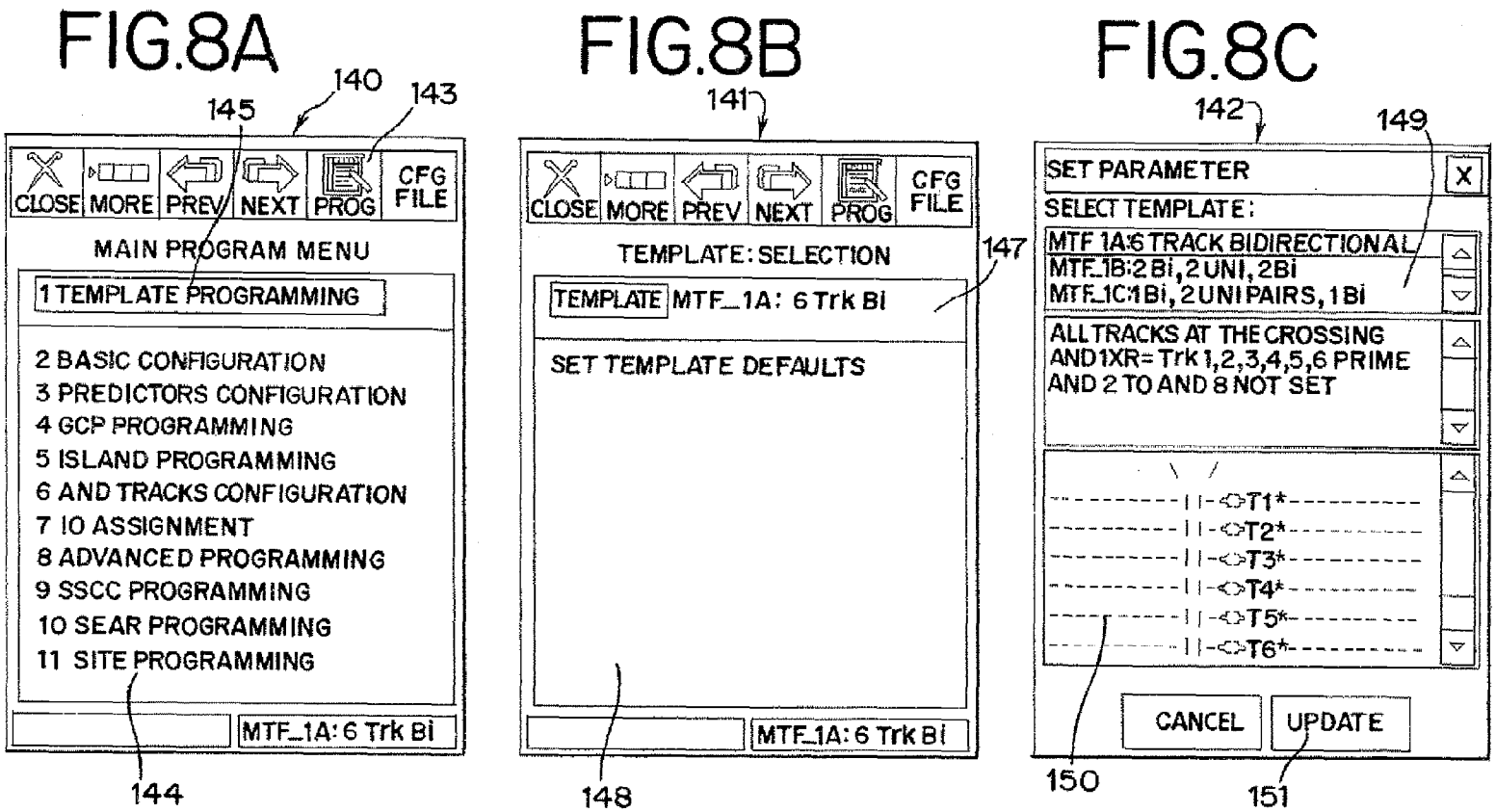
FIG.8A
140
143
145
144
CLOSE
MORE
PREV
NEXT
PROG
CFG FILE
MAIN PROGRAM MENU
1 TEMPLATE PROGRAMMING
2 BASIC CONFIGURATION
3 PREDICTORS CONFIGURATION
4 GCP PROGRAMMING
5 ISLAND PROGRAMMING
6 AND TRACKS CONFIGURATION
7 IO ASSIGNMENT
8 ADVANCED PROGRAMMING
9 SSCC PROGRAMMING
10 SEAR PROGRAMMING
11 SITE PROGRAMMING
MTF_1A: 6 Trk Bi
FIG.8B
141
147
148
CLOSE
MORE
PREV
NEXT
PROG
CFG FILE
TEMPLATE: SELECTION
TEMPLATE
MTF_1A: 6 Trk Bi
SET TEMPLATE DEFAULTS
MTF_1A: 6 Trk Bi
FIG.8C
142
149
150
151
SET PARAMETER
SELECT TEMPLATE:
MTF 1A:6 TRACK BIDIRECTIONAL
MTF_1B:2 Bi, 2 UNI, 2 Bi
MTF_1C:1 Bi, 2 UNI PAIRS, 1 Bi
ALL TRACKS AT THE CROSSING
AND 1XR= Trk 1,2,3,4,5,6 PRIME
AND 2 TO AND 8 NOT SET
T1*
T2*
T3*
T4*
T5*
T6*
CANCEL
UPDATE

TEMPLATE CROSSING DESIGN AND PROGRAMMING FOR HIGHWAY-RAIL GRADE CROSSINGS

FIELD OF THE INVENTION

The present invention relates generally to apparatus for highway-rail grade crossing warning systems. More particularly, the present invention relates to improved apparatus for such crossing warning systems that facilitates more efficient setup, calibration and troubleshooting of the warning systems.

BACKGROUND OF THE INVENTION

It is common practice in highway-railroad grade crossing warning systems for control circuitry to consist of an arrangement of electromagnetic relays operating on 12 volts DC nominal, or electronic processor equivalent inputs and outputs (I/O) operating on the same voltage. The control circuitry, which flashes the lights and operates the gates if so equipped, receives its input from train detection circuit outputs. The control and train detection circuitry operate on closed circuit fail-safe design principles. An electrical interruption, (i.e., short, or open) in the circuitry results in activation of the warning devices, i.e., the flashing lights activate and the gates descend.

Current industry practice for designing highway-rail grade crossing applications using industry standard electronic train detection equipment, such as the Safetran Systems Corporation GCP 3000 Grade Crossing Predictor or the GE Transportation Systems Harmon Crossing Processor HXP-3, is to identify individually all of the parameter settings required by the electronic equipment at the crossing. These devices provide an output that signals solid-state electronic equipment, such as Safetran Systems Corporation SSCC-III crossing controller or vital signaling relays to provide appropriate warning to the road users, typically by means of flashing lights, barrier gates and bells. Electronic crossing controllers also require a set of programming parameters, which are currently specified individually. A solid-state recording device, such as the Safetran Systems Corporation SEAR-II or the GE Transportation Systems HAWK, will typically monitor the train detection and the crossing control functions. These recording devices also require a set of programming parameters, which are specified individually.

With all of the individual parameters for each of these systems, even simple crossings can have in excess of 100 parameters that need to be programmed before the system is operational. More complex crossings can have well in excess of 500 parameters. Parameters may include items such as the number of tracks at a specific crossing location, whether the controller operates in a uni-directional or bi-directional mode, whether the controller communicates with adjacent controllers as well as specific information for each approach and island circuit. This large number of parameters places a large burden on the crossing designer to make sure every parameter is correct. Similarly, a large burden is placed on the person programming the units in terms of the time required and making sure that each system is programmed correctly. Additionally, such systems typically undergo some form of repair and/or maintenance at a future time that will require some or all of the programming parameters to be reentered.

A general object of the present invention is to provide a simplified means of designing applications for a controller for a highway-rail grade crossing.

Another object of the present invention is to provide a plurality of application templates for programming each parameter of a controller for most highway-rail grade crossing configurations.

A further object of the present invention is to reduce programming time and increase programming accuracy by utilizing template default parameters.

Yet another object of the present invention is to provide flexibility in programming of a controller as the field conditions change or evolve.

A still further object of the present invention is to provide quicker and more accurate technical support with template programming.

SUMMARY OF THE INVENTION

This invention is directed to a method of programming application logic in a controller for a highway-rail grade crossing warning system, the method including the steps of providing a set of templates, each template of the set of templates defining a track circuit application for a grade crossing with different characteristics from other templates in the set of templates, selecting a template from the set of templates that best corresponds to the track circuit application at the grade crossing or a remote location, the selected template defining a set of default programming parameters for programming of the controller, and inputting additional parameters into the controller that define other characteristics of the track circuit application. This method may include the step of providing a visual representation of a different track circuit application for each of the set of templates.

The method may also include one or more of the following additional steps of defining a portion of the set of templates to include a related set of track circuit applications, with all track circuits at the grade crossing; defining a portion of the set of templates to include a related set of track circuits, with the track circuits mixed between the grade crossing and remote locations, and with all remote locations communicating toward the subject grade crossing; defining a portion of the set of templates to include a related set of track circuits, with the track circuits mixed between the subject grade crossing and remote locations, and with all remote locations communicating in opposite directions; defining a portion of the set of templates to include at least one track circuit, with all track circuits being remote locations, and with all remote locations communicating in the same direction; and defining a portion of the set of templates to include at least one track circuit, with all track circuits being remote locations, and with all remote locations communicating in opposite directions.

The invention is further directed to a set of templates for programming of a controller for a highway-rail grade crossing warning system, wherein each of said set of templates includes a visual representation of a different track circuit application for a highway-rail grade crossing and each of said set of templates includes default programming parameters relating to the respective different track circuit. When one of the set of templates is selected, the selected template provides default programming parameters to the controller for a track circuit that corresponds to the selected template.

A portion of the set of templates may define a related set of track circuit applications, with all track circuits at the grade crossing; a related set of track circuits, with track circuit applications mixed between the grade crossing and remote locations, and with all remote locations communicating toward the subject grade crossing; a related set of track circuits, with track circuits mixed between the subject grade crossing and remote locations, and with remote locations communicating in opposite directions; at least one track circuit, with all track circuits being remote locations, and with all remote locations communicating in the same direction; and/or at least one track circuit, with all track circuits being remote locations, and with all remote locations communicating in opposite directions.

Yet another aspect of the present invention includes a method of designing application logic for a highway-rail grade crossing warning system including the steps of providing a set of templates, each template of the set of templates defining a different track circuit application for a grade crossing from other templates in the set of templates, providing a visual representation of the different track circuit associated with each of the set of templates, and selecting a template from the set of templates that best corresponds to the track circuit application at the grade crossing. The method of designing may include the additional steps of providing a set of default programming parameters corresponding to the selected template to a controller for programming of the warning system and inputting additional parameters into the controller that define other characteristics of the track circuit and controller application.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which:

FIGS. 8A through 8C are typical screens which appear on a display of the controller of FIG. 2 to assist in default parameter programming of the controller with the sets of templates shown in FIGS. 3-7.

DESCRIPTION OF THE PREFERRED EMBODIMENTS

It will be understood that the invention may be embodied in other specific forms without departing from the spirit thereof. The present examples and embodiments, therefore, are to be considered in all respects as illustrative and not restrictive, and the invention is not to be limited to the details given herein.

Figure 1:
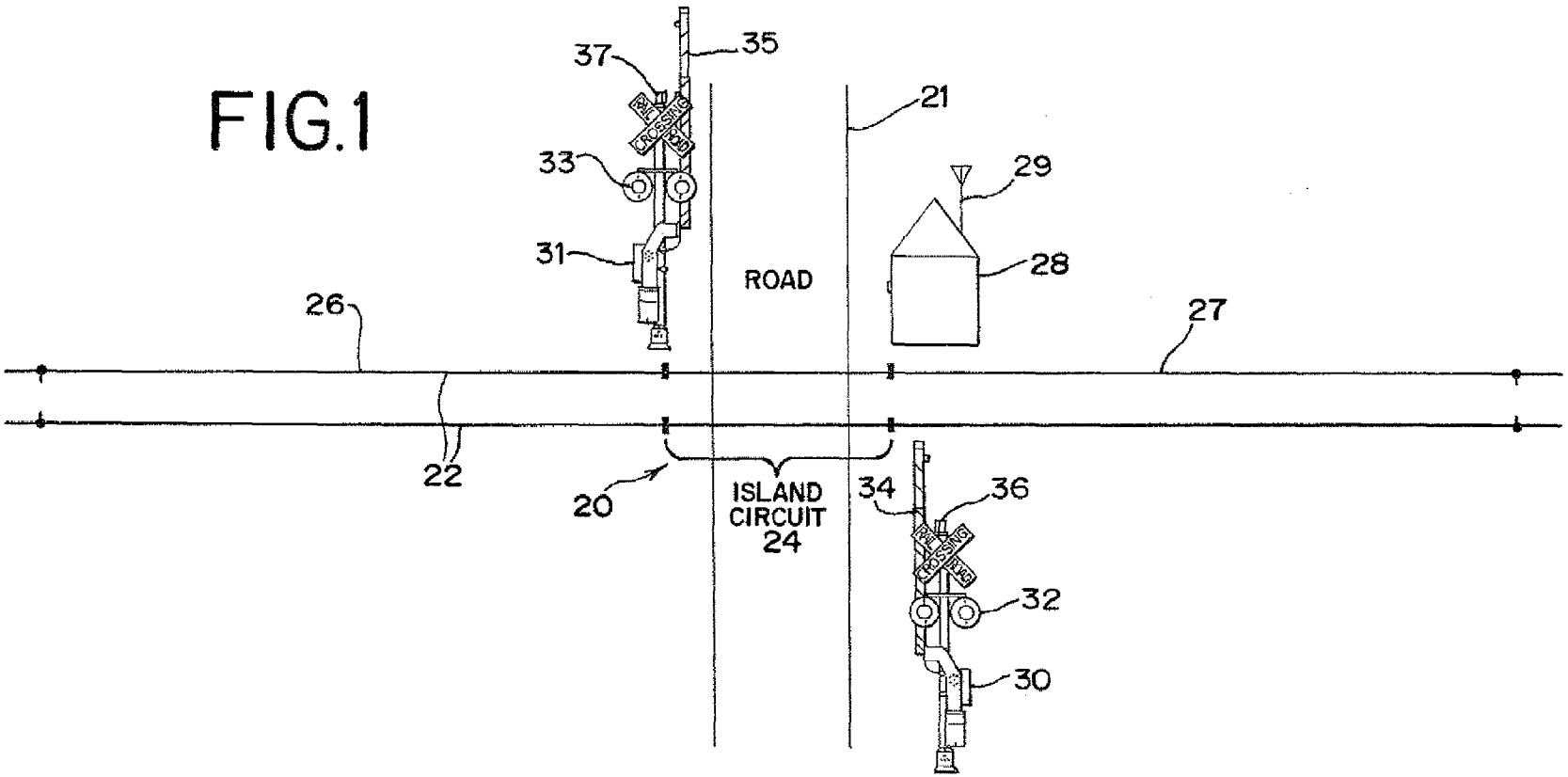
FIG. 1 is a diagrammatic illustration of a highway-rail grade crossing including a warning system.
Figure 2:
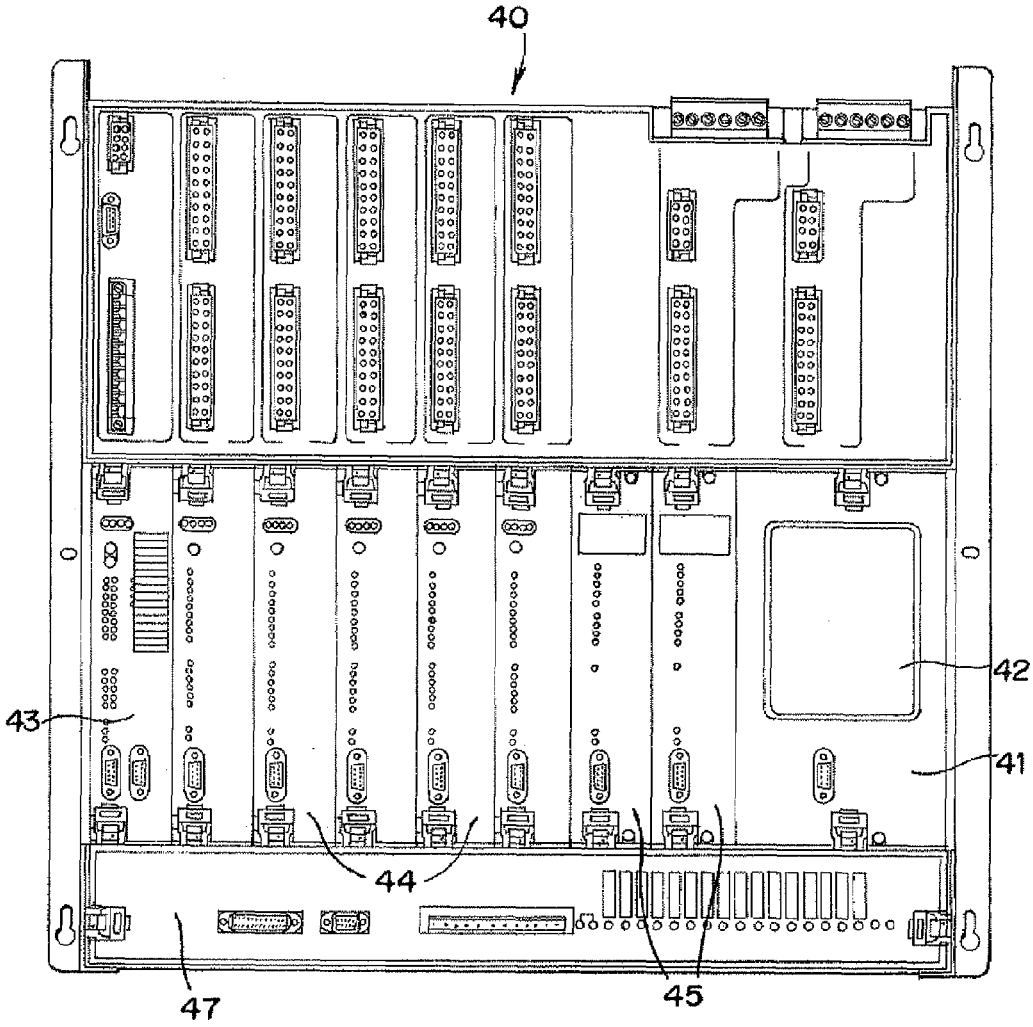
FIG. 2 is an elevational view of a controller for the highway-rail grade crossing of FIG. 1.

With reference to the drawing Figures, FIG. 1 illustrates a highway-rail crossing, generally indicated by reference numeral 20, at a road 21 and at one or more railroad tracks 22. A Grade Crossing Predictor (GCP) system, generally designated 40 in FIG. 2, is enclosed within a generally weatherproof housing or bungalow 28 (FIG. 1), and in general proximity to at least one of the railroad tracks 22. The GCP system 40 will also be hereinafter referred to as a controller or an electronic controller. Preferably, housing 28 is equipped with an antenna 29 to permit reception of signals and to transmit signals, such as between controller 40 and a railroad operations center (not shown).

In a conventional manner, at least that portion of railroad track 22 that intersects with the road 21 is included in an island circuit 24 that is monitored by controller 40. Similarly, those portions of track 22 that lie to the right and to the left of the island circuit 24 are included in an approach circuit are identified by reference numerals 27 and 26, respectively. Approach circuits 26 and 27 are also monitored by the controller 40. Traffic warning devices 30 and 31 are typically placed on both sides of track 22 and adjacent to road 21. These traffic warning devices are provided with flashing lamps 32 and 33, may be provided with gates 34 and 35 that may be lowered and audible devices, such as a bell (not shown) or the like, in a known manner. When a train is detected in the approach circuits 26 and 27 or in the island circuit 24, controller 40 activates the flashing lights 32 and 33 and the audible devices and causes the gates 34 and 35 of traffic warning devices 30 and 31 to be lowered.

With reference to FIG. 2, the GCP system or controller 40 is an integrated system that includes all of the control, train detection, and monitoring of a highway-railroad grade crossing warning system, such as for the highway-rail crossing 20 shown in FIG. 1. The railroad grade crossing 20 may include a plurality of tracks, instead of the single track 22 shown. Likewise, controller 40 may monitor and control a plurality of tracks; for example, typically up to six tracks.

As shown in FIG. 2, controller 40 includes a plurality of modules. One of these modules is a display module 41 with a display 42. Preferably, display 42 is a touch screen display that provides a user interface. For example, the Windows CE® operating system, commercially available from the MicroSoft Corporation of Redmond, Wash., may be employed in controller 40 to provide touch screen display capabilities for display 42 that allow the signal maintainer to program and configure the various parameters. Other modules may include a central processing unit (CPU) 43, track modules 44 for monitoring each track, crossing control modules 45 for controlling the traffic warning gates 30 and 31 and a recorder module 47 for recording events and conditions at the highway-rail grade crossing 20. As shown in FIG. 2, each of modules 41, 43-45 and 47 may have external connectors, test points and lighted indicators. Controller 40 is integrated into one physical product that is typically located on the railroad right of way. This integration significantly reduces the wiring requirements, but still requires a large number of parameters to be programmed into the equipment to properly define the characteristics of the highway-rail grade crossing application.

Figure 3:
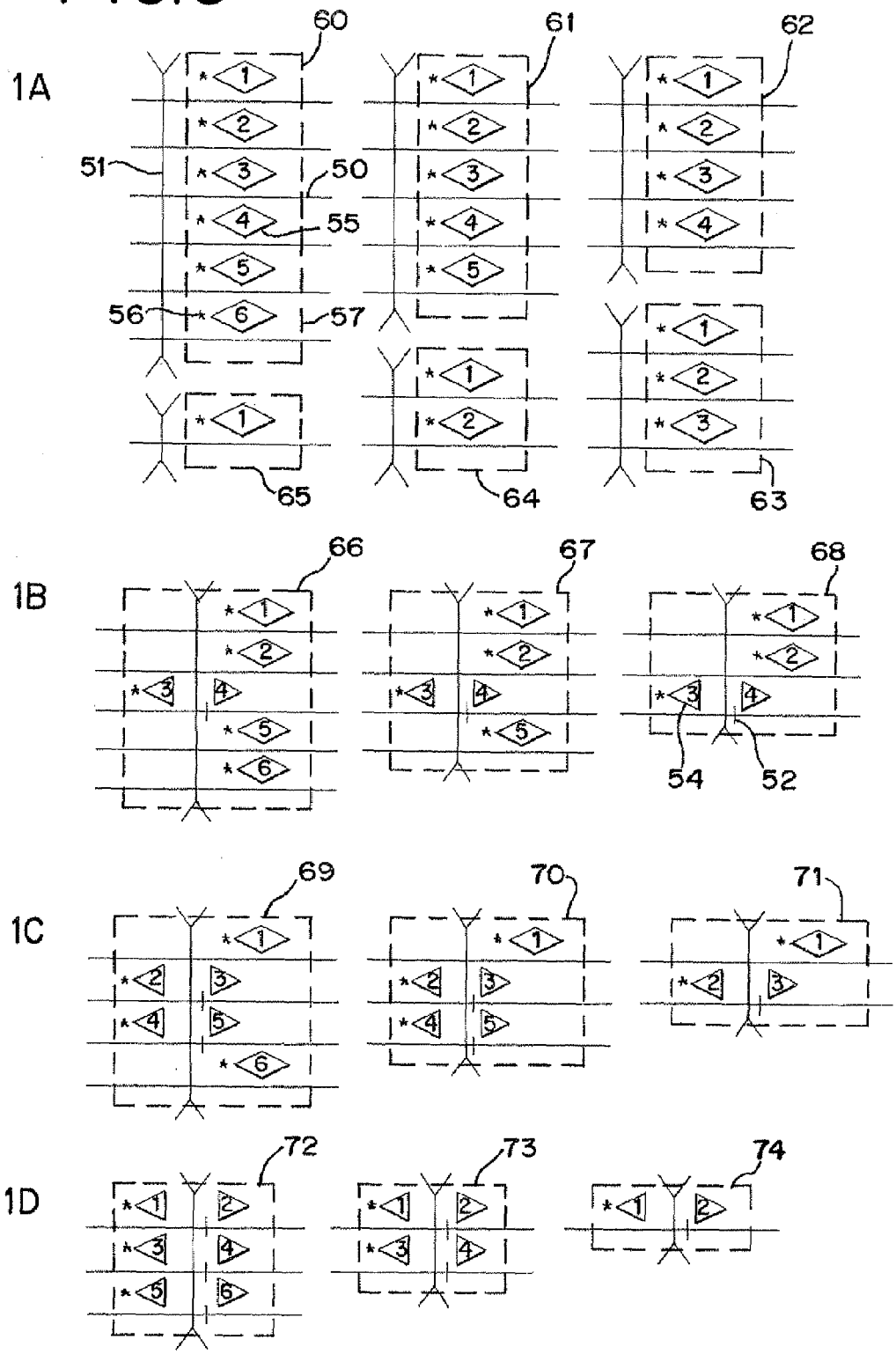
FIG. 3 is a diagrammatic view of a set of templates for programming of the controller of FIG. 2 in which all track circuits are at the grade crossing, such as at the highway-rail grade crossing shown in FIG. 1.
Figure 4A:
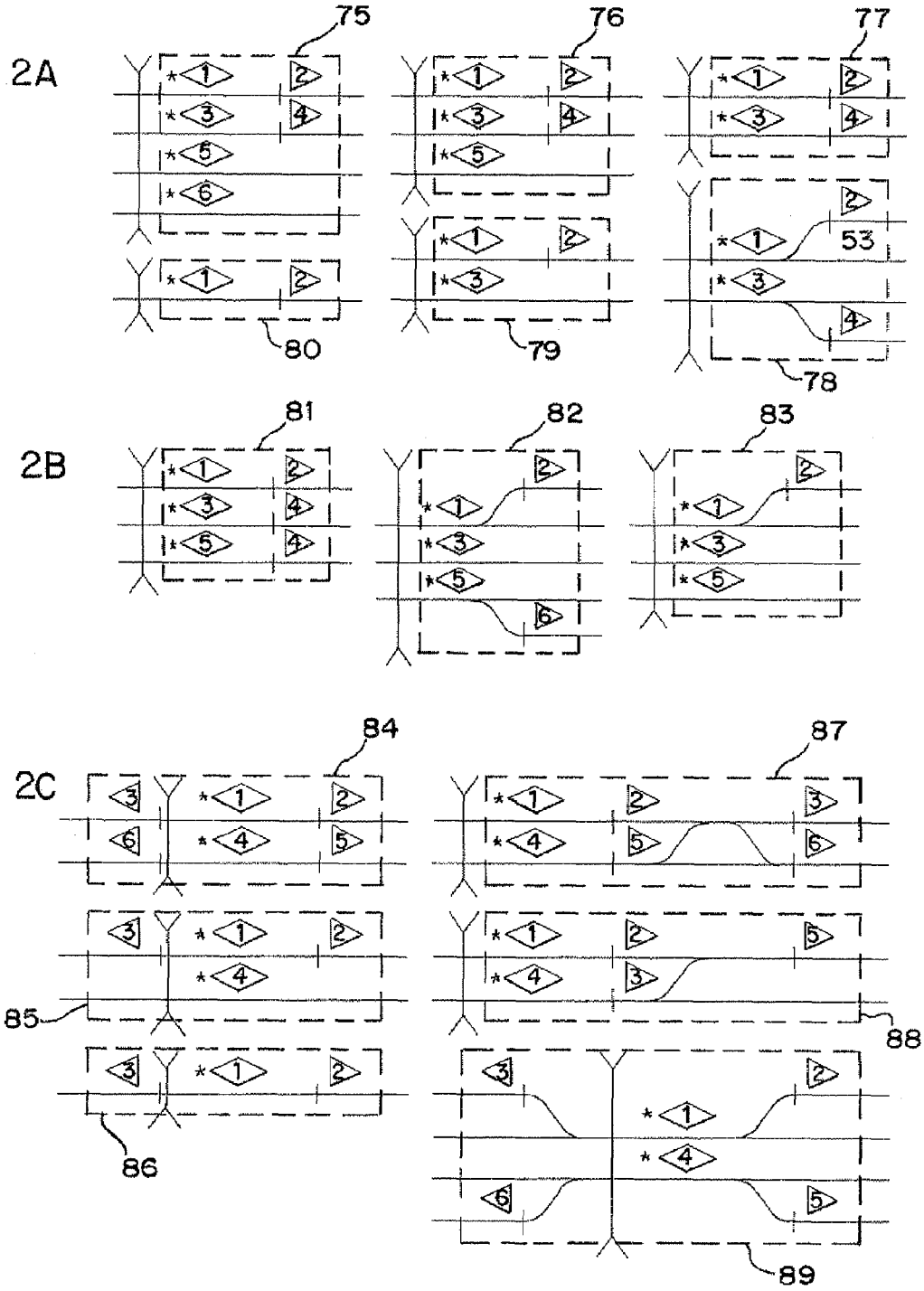
FIG. 4A and 4B are diagrammatic views of a set of templates for programming of the controller of FIG. 2 in which the track circuits are mixed between the crossing and remotes.
Figure 4B:
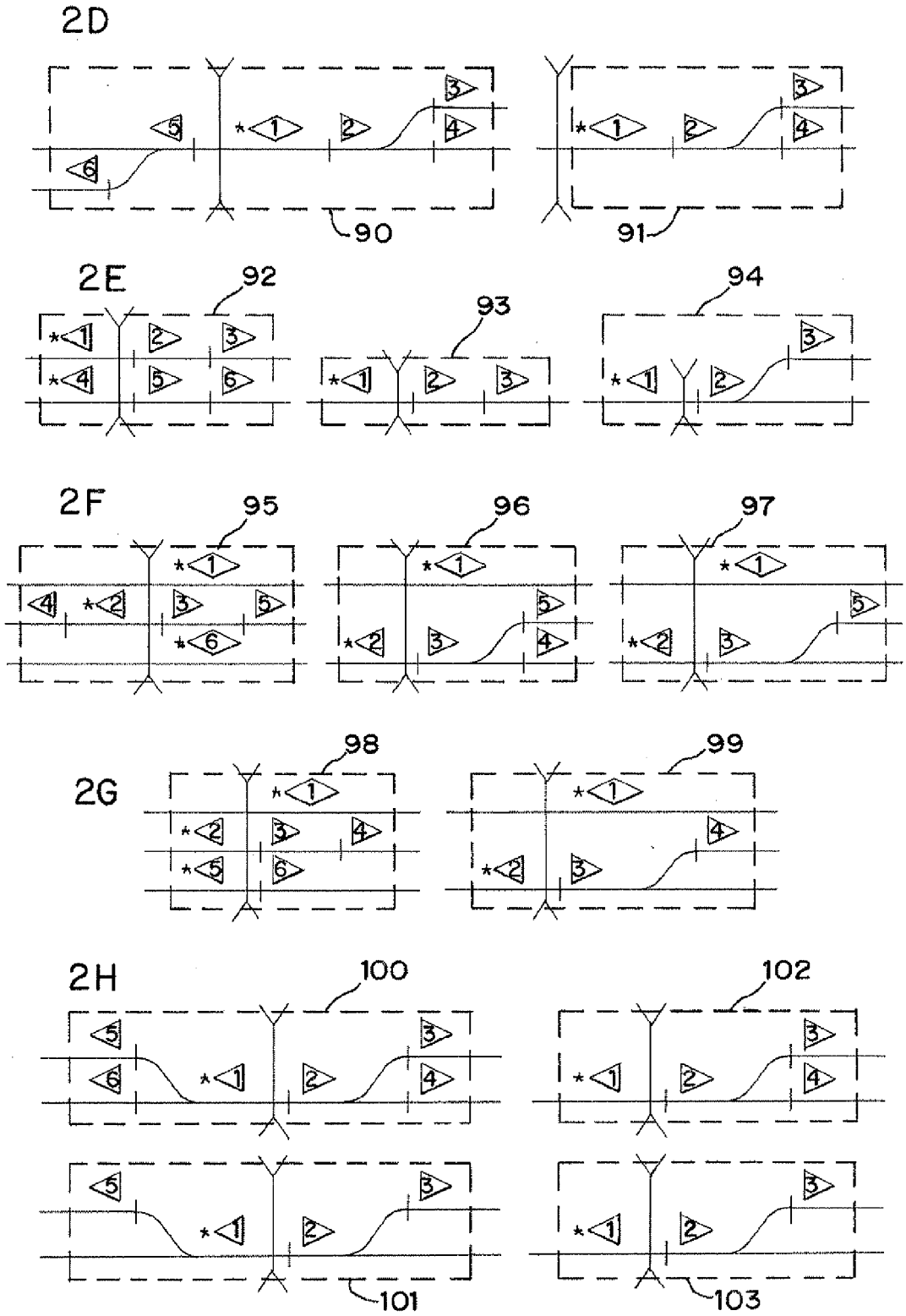
Figure 5A:
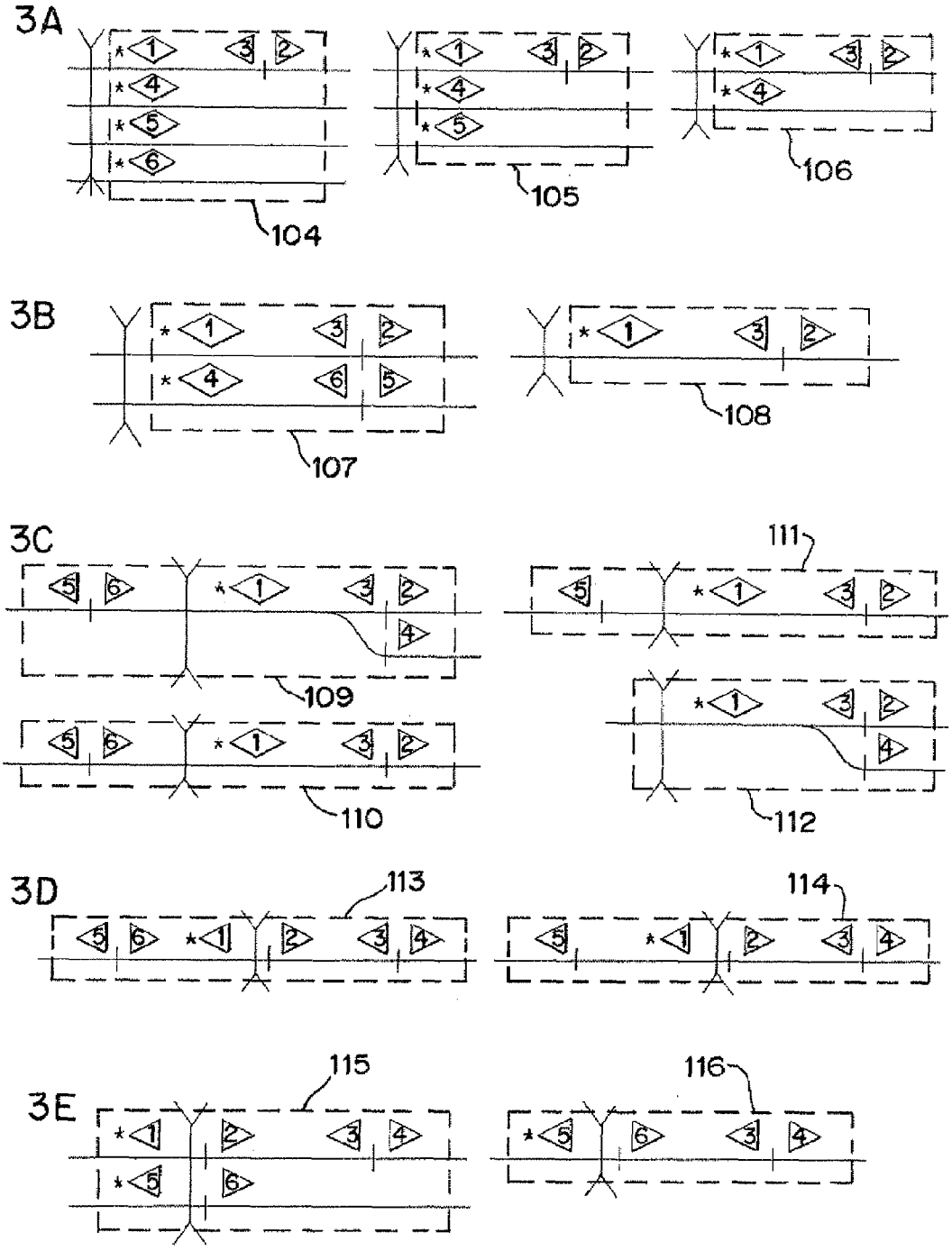
FIG. 5A and 5B are diagrammatic views of a set of templates for programming of the controller of FIG. 2 in which the track circuits are mixed between crossing and remotes and in which remotes communicate in opposite directions.
Figure 5B:
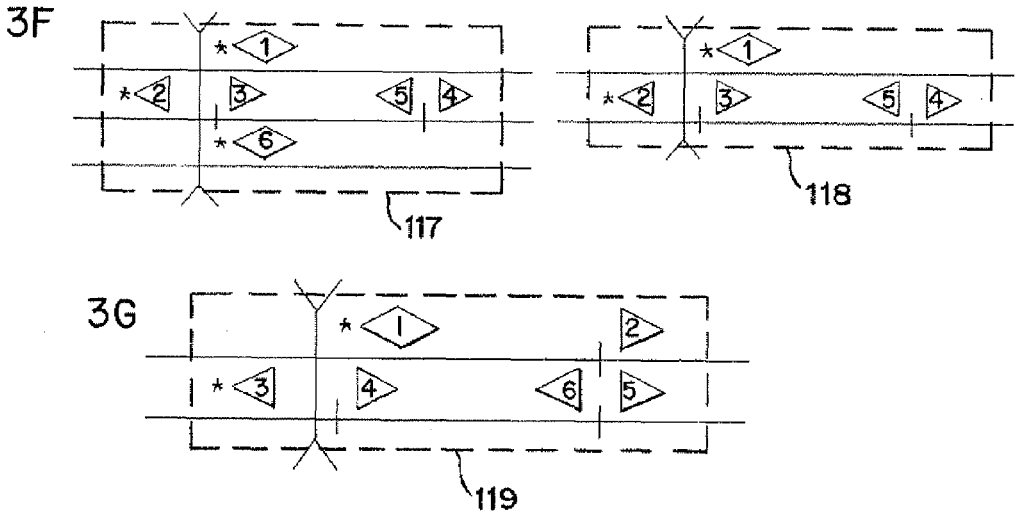
Figure 6:
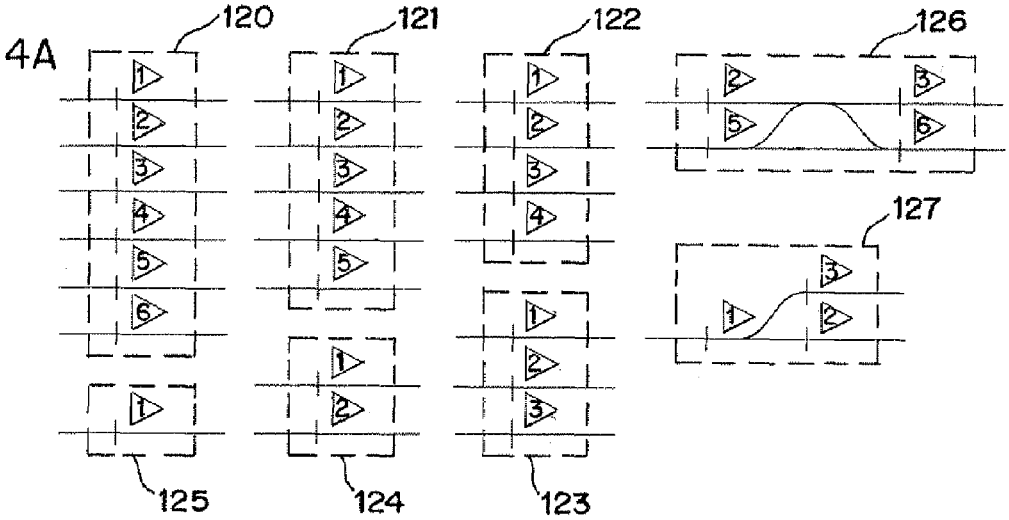
FIG. 6 is a diagrammatic view of a template for programming of the controller of FIG. 2 in which all track circuits are remote and communicate in the same direction.
Figure 7:
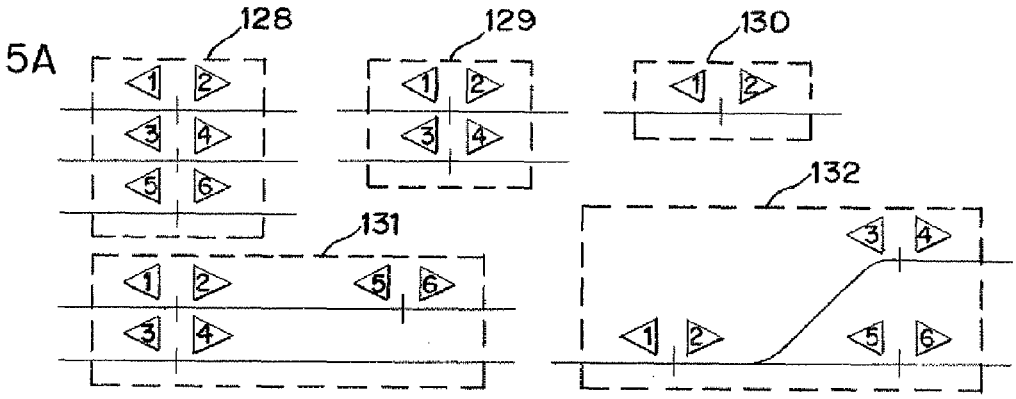
FIG. 7 is a diagrammatic view of a templates for programming of the controller of FIG. 2 in which all track circuits are remote and communicate in opposite directions.

In accordance with one aspect of the present invention, sets of predefined templates are provided for easily selecting typical crossing designs, specifying exceptions to those typical designs, and then providing a minimum set of programming steps for the electronic equipment to be operational, together with a means to verify correct programming of the equipment. These sets of pre-defined crossing application designs or templates are shown in FIGS. 3-7. With reference to FIGS. 3 and 4A, these templates use the following conventions and symbols: (1) horizontal lines 50 (e.g., template 60) represent the railroad tracks (one line represents the two physical rails), (2) a vertical line with inverted arrows on either end 51 represents the road, (3) a small vertical line 52 (e.g., template 68) on the track represents an insulated joint in the railroad tracks, (4) switches 53 (e.g., template 78) are indicated as converging or diverging lines, (5) a triangle symbol 54 (e.g., template 68) with a number inside represents a unidirectional track circuit, (6) a diamond symbol 55 (e.g., template 60) with a number inside represents a bi-directional track circuit, (7) an asterisk 56 (e.g., template 60) indicates that the crossing island circuit is associated with track circuit the asterisk is next to, (8) the direction of the unidirectional track circuit is shown by the orientation of the triangle (the apex of the triangle points in the direction of the approaching train), (9) the dashed line 57 (e.g., template 60) around the track circuits represents the scope of the template, with all template designs being capable of being implemented within one physical controller 40, (10) unidirectional track circuits that are not immediately adjacent to the crossing are termed remotes. These track circuits are often used in downstream adjacent crossing (DAX) applications where train detection information is communicated from one track circuit to another due to constraints of approach distances, train speed or the physical track setup, such as insulated joints. A remote, as used herein, is a track circuit application that is typically deployed physically away from an actual grade crossing, such as to provide DAX communications to other remotes or grade crossings.

The templates 60-132 in FIGS. 3-7 have template rules that specify which track circuits are unidirectional or bi-directional, which track circuits have active islands, which islands are connected to multiple track circuits, which track circuits are remote and DAX to the crossing, which track circuits are remote and DAX away from the crossing, and which track circuits are logically ANDed together to control the crossing. Each template has a specific set of template defaults. These defaults determine the above template rules, in addition to which track circuits are enabled (turned on) by default.

The 21 sets of templates 1A-5A shown in FIGS. 3-7 are split into five main categories to aid in locating the correct template quickly. The first set of templates shown in FIG. 3 includes templates 1A through 1D in which all track circuits are at the crossing. The second set of templates shown in FIG. 4 includes templates 2A through 2H in which the track circuits are mixed between crossing and remotes. All remotes DAX to this crossing in this set of templates. The third set of templates shown in FIG. 5 includes templates 3A through 3G in which the track circuits are mixed between crossing and remotes. Remotes DAX in opposite directions in this set of templates. The fourth set of templates shown in FIG. 6 includes template 4A in which all track circuits are remote and DAX in the same direction. The fifth set of templates includes template 5A in which all track circuits are remote and DAX in opposite directions.

Each template may be applied to multiple track layouts, which gives rise to a number of template variants within each category. In addition, each template has a maximum of 6 track circuits. Any track circuit may be removed during design time while retaining the remainder of the track circuits in their original template configuration. This provides further template variations. The templates can also be applied in a reflective manner, such that any track circuit or combination of track circuits can be rotated around either the crossing or insulated joint.

In order to facilitate efficient template selection by the designer, the number of templates employed was kept to a minimum. With the ability to apply the same template to different track layouts, the capability to adjust the number of track circuits and the reflective capability of the templates, a very large set of applications can be accommodated with just a small number of sets of templates.

When the number of track circuits is adjusted from the template defaults, the system will automatically include or exclude the adjusted track circuit as part of the template rules, including island operation and all associated programming parameters.

The template definitions and template default values are held as part of a Module Configuration File (MCF). This file is processed by the controller 40 when a template is selected. This same MCF may be used by the Diagnostic Terminal (DT) for the controller 40 working in an offline mode, called the Office Configuration Editor. The Office Configuration Editor (OCE) tool runs under the Microsoft Windows operating system, and allows designers to select the appropriate templates without having to be connected in the field with a physical controller 40. This OCE tool also allows the designer to turn track circuits on or off, and to program in the exact order any of the available train detection, crossing control or recorder parameters. Once the designer has completed the design, the OCE tool may be used to generate a minimum program steps report. This report lists the changes or exceptions to the template defaults of the selected template. The report lists the MCF used, the template chosen and the exceptions, which provides complete information in order to program a controller 40, and is typically included as part of the site specific plans.

The controller 40 thus employs a method of programming called template programming. This method allows the user to select the desired template and then step through each programming screen in the order that entries appear in the minimum programs steps report. The user will enter values as determined by the minimum programs steps report, skipping screens that do not have an exception listed. This allows rapid entry of all of the programming parameters. Template programming provides a simplified set of programming steps that are limited to typically required programming options.

For example, the screens 140-142 in FIGS. 8A-8C are representative of the types of screens that will appear on display 42 of controller 40 during the template programming. If the "PROG" field 143 of screen 140 in FIG. 8A is touched, a menu of different programming options will appear in field 144. In the example of FIG. 8A, the first option, "TEMPLATE programming" is highlighted in field 145. In the next screen 141 of FIG. 8B, template selection, the current operational template is identified as 1A in field 147, which corresponds to the set of templates 1A in FIG. 3. This template is also identified as a six track bi-directional template, which is more specifically template 60 of the set of templates 1A. Of course, a six track template can be reduced to fewer tracks by inactivating some of the tracks as part of the programming process. In this respect, templates 61-65 of the set of templates 1A may be derived from template 60, rather than being individually or separately selected.

Activating the template field 147 in FIG. 8B will provide screen 142 in FIG. 8C, which lists the available templates in a field 149. A graphic representation or depiction of the selected template may appear in another field 150 of screen 142 so that the user can visually identify or confirm the selected template. Touching of the update button 151 on screen 142 will change any previously selected template to the newly selected template. If the template is changed, all site specific parameters must be reprogrammed.

Figure 9:
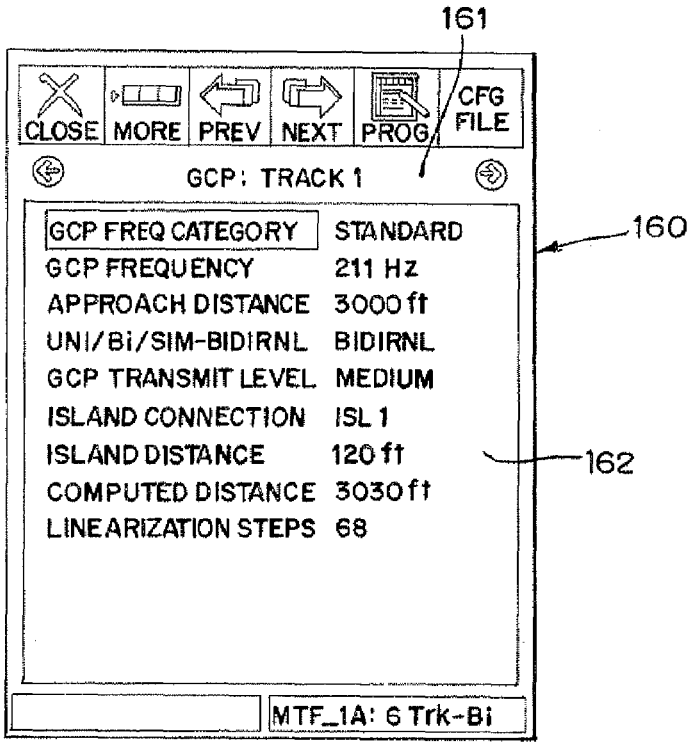
FIG. 9 is an example of another screen which may appear on the display of the controller of FIG. 2 to assist in the programming of other parameters that are not included in default parameters provided by the templates of FIGS. 3-7.

Once template programming has been completed, default values are entered for all programmable parameters. The user will enter new values for any parameters that differ from the default parameters predefined by the selected template. That is, the templates predefine or characterize the many parameters that would otherwise need to be manually entered into the controller 40. For example, in the screen 160 in FIG. 9 indicates that GCP programming for the approach circuits 26 and 27 in FIG. 1 has been selected for track 1 in field 161. Some of the additional parameters that can be programmed for the track circuit as part of the GCP programming are listed in field 162. Note that this GCP programming is also the fourth item in screen 140 in FIG. 8A. The parameters that may need to be manually entered are also listed in the minimum program steps report. When programming on the controller 40 has been completed, the user may verify that the programming parameters have been entered correctly by verifying the office configuration check number. This number is a 32-bit cyclical redundancy check (CRC) number that is calculated over the program parameters, omitting any parameters that are determined in the field, such as approach distance. This number is included as part of the minimum program steps report.

The controller 40 incorporates an extensive set of predefined logic functions, for example, AND 1 XR, Track 1 Prime UAX, etc. As part of the template selection and programming, the functions that are required for the application are selected. The names of these functions and whether they are associated with any physical input or output are automatically sent to the recorder 47, avoiding extra time for the recorder set up.

There are at least several key advantages to this the template programming of a highway-grade crossing. Design time is significantly reduced since many programming parameters are already established by the selected template. That is, the templates essentially abstract the crossing design to a higher-level. Designs of crossing applications become more standardized since all designers utilize the same sets of templates that also utilize the same template defaults. Programming time is reduced and accuracy is improved since the users program by exception, rather than by programming each individual parameter. As a result, a significantly smaller number of parameters are entered. The sets of templates allow designers to specify precisely what is required, while still allowing flexibility for field changes as conditions dictate or require. New templates may be easily established as crossing designs evolve. The minimum program steps reports are text files that can be easily compared or incorporated into CAD systems. A check number may be provided to compare the as-programmed field equipment with the designer site plans. Technical support will be quicker and more accurate, since users can quickly and accurately identify the programming parameters which are exceptions to the default programming parameters of the selected template.

While particular embodiments of the invention have been shown and described, it will be obvious to those skilled in the art that changes and modifications may be made therein without departing from the invention in its broader aspects.

The invention claimed is:

1. A method of programming application logic in a controller for a highway-rail grade crossing warning system with a set of templates, each template in the set of templates defining a track circuit application for a grade crossing or remote location with different characteristics from other templates in the set of templates, said method comprising the steps of:

selecting a template from the set of templates that corresponds to the track circuit at the grade crossing;

said selected template including a set of default programming parameters for programming of the controller;

wherein the step of selecting a template that corresponds to the track circuit is based upon whether all of the track circuits are at the grade crossing; and using the default programming parameters for initial programming of the controller.

2. The method in accordance with claim 1, wherein the step of selecting a template that corresponds to the track circuits is further based upon whether the track circuits are mixed between the grade crossing and remote locations, and whether all remote locations communicate toward the grade crossing.

3. The method in accordance with claim 1, wherein the step of selecting a template that corresponds to the track circuit is further based upon whether the track circuits are mixed between the grade crossing and remote locations, and whether remote locations communicate in opposite directions.

4. The method in accordance with claim 1, wherein the step of selecting a template that corresponds to the track circuit is further based upon whether all track circuits are remote locations, and whether all remote locations, communicate in same directions.

5. The method in accordance with claim 1, wherein the step of selecting a template that corresponds to the track circuit is further based upon whether all track circuits are remote locations, and whether remote locations communicate in opposite directions.

6. The method in accordance with claim 1, said method comprising the additional step of:

providing a visual representation of a different track circuit application for each template in the set of templates.

7. The method in accordance with claim 1, said method comprising the additional step of:

storing the set of default programming parameters from the selected template in a memory to reduce the number of remaining programming steps.

8. The method in accordance with claim 1, said method comprising the additional step of:

changing certain parameters in the set of default programming parameters provided by the selected template for final programming of the controller.

9. A set of templates for programming of a controller for a highway-rail grade crossing warning system, said set of templates comprising:

each template in the set of templates includes a visual representation of a different track circuit application for a highway-rail grade crossing or for a remote location; and each template in the set of templates includes default programming parameters relating to the respective different track circuit application.

10. The set of templates for programming of a controller for a highway-rail grade crossing warning system in accordance with claim 9, when one of said set of templates is selected, the selected template provides default programming parameters to the controller for a track circuit that corresponds to the selected template.

11. The set of templates for programming of a controller for a highway-rail grade crossing warning system in accordance with claim 9, a portion of said set of templates defines a related set of track circuit applications, with all track circuits at the grade crossing.

12. The set of templates for programming of a controller for a highway-rail grade crossing warning system in accordance with claim 9, a portion of said set of templates defines a related set of track circuit applications, with track circuits mixed between the grade crossing and remote locations, and with all remote locations communicating toward the grade crossing.

13. The set of templates for programming of a controller for a highway-rail grade crossing warning system in accordance with claim 9, a portion of said set of templates defines a related set of track circuit applications, with track circuits mixed between the grade crossing and remote locations, and with remote locations communicating in opposite directions.

14. The set of templates for programming of a controller for a highway-rail grade crossing warning system in accordance with claim 9, a portion of said set of templates defines at least one track circuit application, with all track circuits being remote locations, and with all remote locations communicating in the same direction.

15. The set of templates for programming of a controller for a highway-rail grade crossing warning system in accordance with claim 9, a portion of said set of templates defines at least one track circuit application, with all track circuits being remote locations, and with remote locations communicating in opposite directions.

16. A method of designing a track circuit application for use by a controller in a highway-rail grade crossing warning system, said method comprising the steps of:

providing a set of templates, each template in the set of templates defining a different track circuit application for a grade crossing or remote location from other templates in the set of templates;

providing a visual representation of the different track circuit application associated with each of the set of templates; and selecting a template from the set of templates that corresponds to the track circuit at the grade crossing or remote location;

wherein the step of selecting a template that corresponds to the track circuit is based upon whether all of the track circuits are at the grade crossing;

said selected template including a set of default programming parameters for initial programming of the controller.

17. The method of designing a track circuit application for a highway-rail grade crossing warning system in accordance with claim 16, said method comprising the additional step of:

changing certain parameters in the set of default programming parameters provided by the selected template for final programming of the controller.

18. The method of designing a track circuit application for a highway-rail grade crossing warning system in accordance with claim 16, said method comprising the additional step of:

storing the set of default programming parameters in the controller to reduce the number of remaining program steps.

19. The method of designing a track circuit application for a highway-rail grade crossing warning system in accordance with claim 16, wherein the step of selecting a template that corresponds to the track circuit is further based upon whether the track circuits are mixed between the grade crossing and remote locations, and whether all remote locations communicate toward the grade crossing.

20. The method of designing a track circuit application for a highway-rail grade crossing warning system in accordance with claim 16, wherein the step of selecting a template that corresponds to the track circuit is further based upon whether the track circuits are mixed between the grade crossing and remote locations, and whether remote locations communicate in opposite directions.

21. The method of designing a track circuit application for a highway-rail grade crossing warning system in accordance with claim 16, wherein the step of selecting a template that corresponds to the track circuit is further based upon whether all track circuits are remote locations, and whether all remote locations communicate in the same direction.

22. The method of designing a track circuit application for a highway-rail grade crossing warning system in accordance with claim 16, wherein the step of selecting a template that corresponds to the track circuit is further based upon whether all track circuits are remote locations, and whether remote locations communicate in opposite directions.

* * * * *